US008316844B2

(12) United States Patent
Bludyan

(10) Patent No.: US 8,316,844 B2
(45) Date of Patent: Nov. 27, 2012

(54) PROTECTIVE HOOD

(75) Inventor: Marina Anatolievna Bludyan, Moscow (RU)

(73) Assignee: Epicentre Market, LLC, Moscow (RU)

( * ) Notice: Subject to any disclaimer, the term of this patent is extended or adjusted under 35 U.S.C. 154(b) by 1471 days.

(21) Appl. No.: 11/658,196

(22) PCT Filed: May 19, 2005

(86) PCT No.: PCT/RU2005/000276

§ 371 (c)(1),
(2), (4) Date: Jan. 22, 2007

(87) PCT Pub. No.: WO2006/033597

PCT Pub. Date: Mar. 30, 2006

(65) Prior Publication Data

US 2008/0135046 A1 Jun. 12, 2008

(30) Foreign Application Priority Data

Sep. 15, 2004 (RU) ..... 2004127533

(51) Int. Cl.
*A62B 7/10* (2006.01)
*A62B 19/00* (2006.01)
*A62B 23/02* (2006.01)

(52) U.S. Cl. ..... 128/201.25; 128/201.22; 128/201.23; 128/201.28; 128/205.27; 128/205.29

(58) Field of Classification Search ..... 128/201.25, 128/201.28, 201.24, 201.22, 201.23, 201.29, 128/206.12, 206.16, 206.17, 205.27, 205.28, 128/205.29
See application file for complete search history.

(56) References Cited

U.S. PATENT DOCUMENTS

| | | | | |
|---|---|---|---|---|
| 4,515,156 | A * | 5/1985 | Khudosovtsev et al. | 128/202.26 |
| 4,805,608 | A * | 2/1989 | Eckstein et al. | 128/202.26 |
| 5,186,165 | A | 2/1993 | Swann | |
| 5,526,804 | A * | 6/1996 | Ottestad | 128/201.25 |
| 5,996,580 | A * | 12/1999 | Swann | 128/206.17 |
| 6,041,778 | A * | 3/2000 | Swann et al. | 128/201.25 |
| 6,340,024 | B1 * | 1/2002 | Brookman et al. | 128/201.25 |
| 6,834,646 | B2 * | 12/2004 | Alon et al. | 128/201.22 |
| 6,860,267 | B2 * | 3/2005 | Capon et al. | 128/206.15 |

FOREIGN PATENT DOCUMENTS

| | | |
|---|---|---|
| DE | 3931682 A1 | 4/1991 |
| DE | 41 01 161 A1 | 8/1991 |
| EP | 0148325 A2 | 7/1985 |

(Continued)

OTHER PUBLICATIONS

International Search Report for International Application No. PCT/RU2005/000276 mailed Jul. 14, 2005.

(Continued)

*Primary Examiner* — Justine Yu
*Assistant Examiner* — Colin W Stuart
(74) *Attorney, Agent, or Firm* — Holtz, Holtz, Goodman & Chick, PC

(57) ABSTRACT

The invention relates to life-saving engineering. The inventive protective hood is embodied in the form of a bag comprising a sorbing-filtering insert, a sorbent container, an exhalation valve, a mouthpiece assembly and a spring element for compressing and the extending the bag. Said hood is a small-sized, has a simple structural design, provides a high protection level and is easy to use.

15 Claims, 2 Drawing Sheets

FOREIGN PATENT DOCUMENTS

| | | | |
|---|---|---|---|
| GB | 2 236 938 | A | 4/1991 |
| RU | 15285 | U1 | 10/2000 |
| RU | 2 171 124 | C1 | 7/2001 |
| RU | 2233680 | C1 | 8/2004 |
| WO | WO 88/06907 | | 9/1988 |

OTHER PUBLICATIONS

Supplementary European Search Report dated Oct. 3, 2007 issued by the European Patent Office in related Application EP 05 74 9518 (2 pages).

* cited by examiner

PROTECTIVE HOOD

This is a National Phase Application of International Application PCT/RU2005/000276 filed May 19, 2005, which claims priority from Russian Patent Application Serial No. 2004127533 filed Sep. 15, 2004, the entire contents of each of which are incorporated herein by reference.

FIELD OF THE INVENTION

The present invention relates to a compact device of individual protection that may be used in protective clothes in the field of rescue services. In particular, the present invention relates to a hood that protects the head of the wearer in fires against exposure to heat and toxic substances (primarily against poisonous chemical agents).

DESCRIPTION OF THE PRIOR ART

Due to natural disasters, man-made accidents, and a growing number of terrorist acts, the importance of various kinds of protective devices for the population is rapidly increasing. Means of individual protection play a special role in this context. As such devices should continuously accompany the user, it is desirable that individual protective means be highly compact. In fact, it is the difficulty of achieving a high degree of portability in such devices that has hampered their widespread introduction. The existing means of protection have considerable size and weight that prevent the user from continuously carrying them and, in at least several cases, the absence such devices has resulted in human deaths. Utility Model RU 35237 discloses a protective hood comprising a bag made of flexible, partly transparent air-tight (hermetic) film and an insert of sorptive filtering material in the form of a skirt, wherein the edge of the bag's opening is connected to the upper edge of the skirt. During utilization, air passes through the insert and is subjected to multi-stage purification. The bag may be optionally manufactured with a stitch joining the edge of the bag's opening and the upper edge of the skirt that passes around the head between the eyes and the respiratory organs of the user. However, such protective hood fails to provide a high degree of protection against toxic gases and restricts the field of vision.

U.S. Pat. No. 5,186,165 describes another hood comprising a mouthpiece, valves of inhalation and exhalation, and a cartridge filled with anti-aerosol filtering material and layers of desiccant and of hopcalite adsorbent. However, the filter of the hood has a high aerodynamic resistance.

In RU 2171124, a filtering cartridge of a lower aerodynamic resistance is disposed within a transparent hood worn on the head and fastened on the user's neck with cords. The cartridge contains a folded anti-aerosol filter sealed with a rubber gasket, a ring and a zigzagging net. Layers of desiccant and hopcalite are disposed between two nets in a ratio of 1:(4-5) with respect to volume. The saddle of an inhalation valve, which has a defined passing cross-section, is disposed on a zigzagging divider, while the saddle of an exhalation valve and a socket connected to a mouthpiece are disposed on a lid.

However, such a protective hood provides insufficient degree of protection against certain types of chemicals and its bulky design prevents the user from continuously carrying the device.

According to Utility Model RU 15285, a prototype of a proposed technical solution takes the form of a protective hood comprising: a bag made of flexible, transparent, and heat-resistant material; a multilayer sorptive filtering insert disposed within said hood in the area of the user's respiratory organs made of soft material, said filtering insert comprising at least one layer of fiber heat-resistant material, one layer of anti-aerosol material and a hygienic layer directed towards the respiratory organs of the user; a mouthpiece disposed within said hood at the level of the user's mouth; a flexible intermediate element fixed between the filtering insert and the bag's transparent material, forming a cavity—a respiration chamber between the mentioned elements; and a reverse valve disposed on the bag's transparent material or on the filtering insert.

Such a hood provides a high degree of protection against poisonous chemical agents during the guaranteed protective time. However, the hood suffers from the drawback that the package is of a considerable size in the folded form. Thus, the hood is not compact enough to be continuously carried by the user. Indeed, experiences have shown that in a number of emergency situations the health and the life of a person strictly depend on the above condition.

SUMMARY OF THE INVENTION

An object the present invention is to develop a hood as an efficient protective device against toxic substances in a compact package, allowing it to be continuously carried by the user.

According to the present invention, there is provided a protective hood comprising: a bag made of air-tight, heat-resistant, and at least partly transparent film; a sorptive filtering element disposed within said film having at least an anti-aerosol layer and a base, said base being hermetically connected to said film in the form of a lid; a canister filled with solid sorbent; and a shaping component that keeps the sorptive filtering element in operational mode, said shaping component having the form of a resilient element installed so as to effect compression or expansion of the sorptive filtering element; wherein said canister and said shaping component are disposed in succession under the lid in the cavity of the bag.

It is preferable that the shaping component has the form of a spiral spring that stays in contact with the canister filled with solid sorbent.

It is desirable that the hood be equipped with a heat-resistant cover that surrounds the whole sorptive filtering element.

It is desirable that the heat-resistant cover that surrounds the sorptive filtering element be fixed on the base.

It is preferable that the hood has a mouthpiece and/or an exhalation valve, both installed in the openings of the base.

It is preferable that the canister filled with solid sorbent be installed in away that provides for easy replacement and be fixed on the base with the elastic clamps positioned on said canister and said base.

It is preferable that the sorptive filtering element be multilayered (layers of soft fiber material), with the layers of the sorptive filtering element made of a non-woven polymer fabric, such as perchlorvinyl fibers (as in the Petrianov filter, for example).

As a solid sorbent for filling the canister, activated charcoal should be used.

It is preferable that a dividing element be installed between the base and the canister filled with solid sorbent.

In addition, it is preferable that the mentioned dividing element between the base and the canister filled with solid sorbent be in the form of one or several protrusions on the respective surface of the base.

Finally, it is preferable to have on the base and on the canister filled with solid sorbent a means for detachable joining of said base and said canister.

The resilient element installed inside the bag makes it possible combine a maximal surface area of the sorptive filtering element and a minimal volume of the hood (in the folded form).

The presence of the canister filled with solid sorbent results in removal of toxic substances from the ambient air on its way to the user's respiration organs.

Detachable joining of the canister and the base makes it possible to manufacture a hood in which said canister is easily replaceable (the sorbent is the element that is most quickly loses its effectiveness in similar protective devices), which results in reusability and a prolonged utilization lifetime of the hood and thus helps reduce the operating costs.

Figure 1:
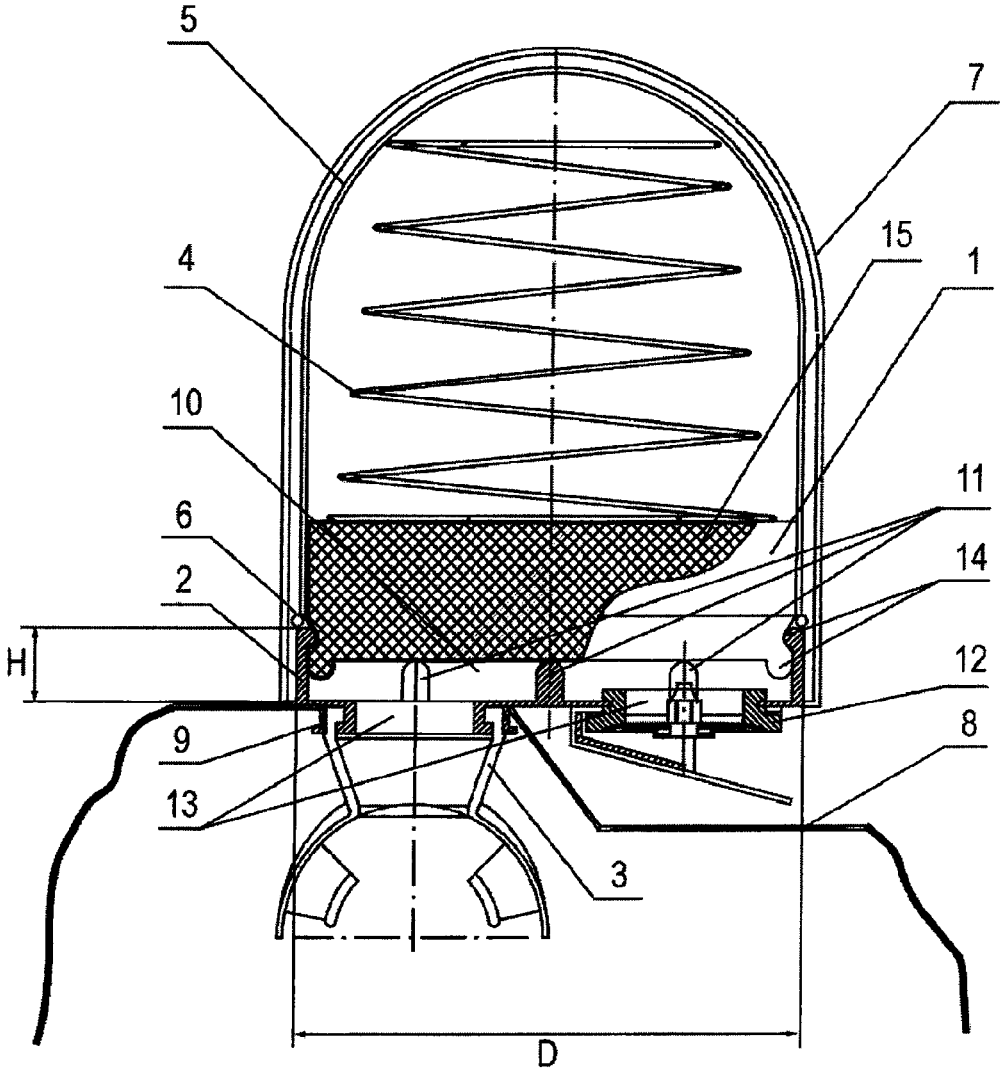
FIG. 1 is a cross-sectional view of the protective hood of the present invention.
Figure 2:
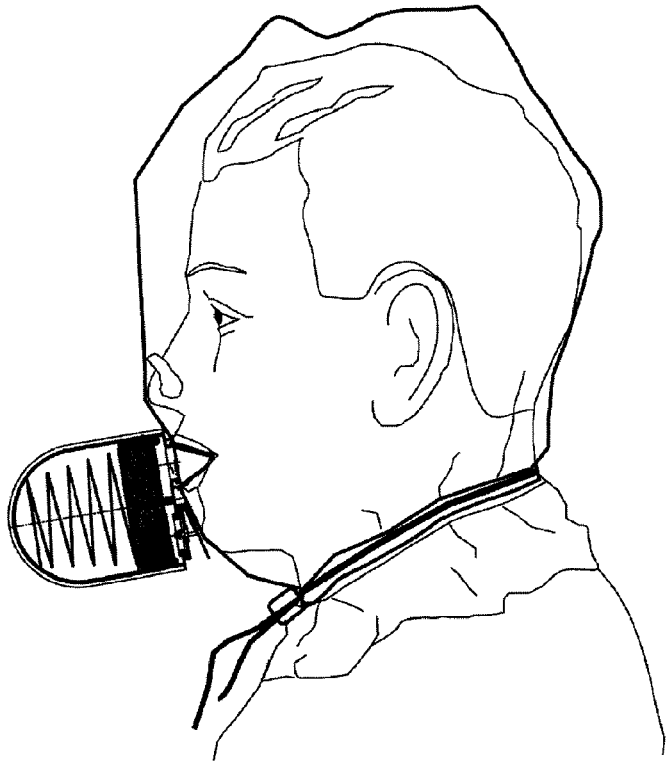
FIG. 2 illustrates the hood of the present invention employed by a user.
Figure 3:
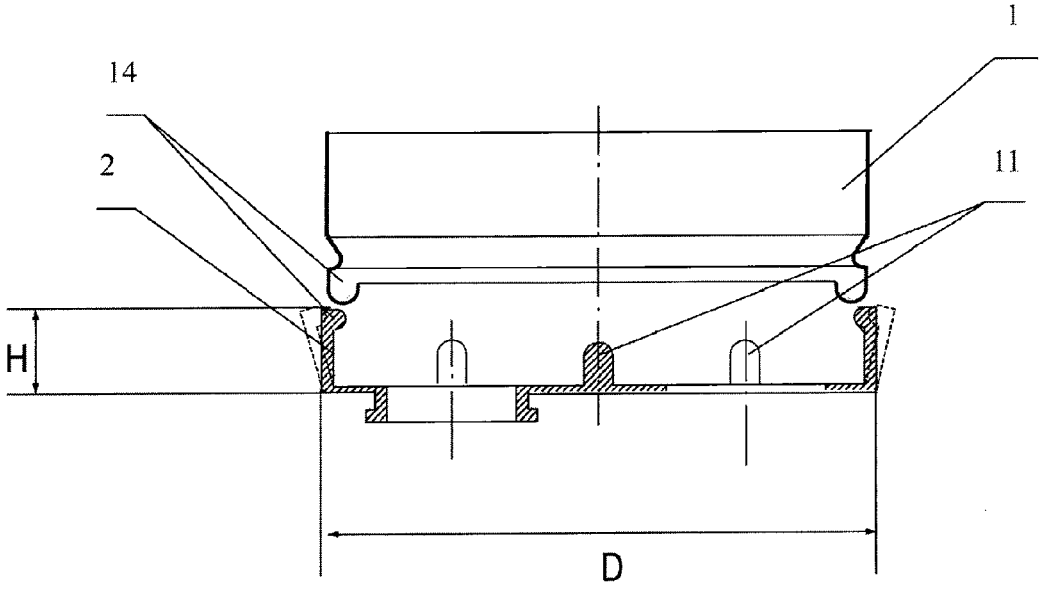
FIG. 3 illustrates a portion of the protective hood illustrated in FIG. 1 in a disengaged state, where.

1 canister filled with sorbent 15 (a plastic box filled up with activated charcoal, for example);

2 base in the form of a lid (cast plastic object), which has the form of a flat cylinder, the diameter D of the base is bigger than the height H of its side part (D>H);

3 mouthpiece (assembled unit of silicon parts);

4 shaping component of the operational position of the multilayer sorptive filtering element, in the form of a resilient element (i.e. has the property of elastic deformation, mainly along the longitudinal axis, and of regaining its volume after removal of the load, such as a spiral spring, for example);

5 multilayer sorptive filtering element (based on the Petrianov fabric).

6 pressing hermetic sealing ring in the form of a ring capable of elastic stretch in order to seal the joint between the base 2 and the element 5;

7 heat-resistant cover (of fabric, for example);

8 bag of heat-resistant transparent air-tight film;

9 fixing ring (has elastic properties making it possible to additionally seal the joint);

10 respiration chamber;

11 dividing element (in the form of several protrusions distributed uniformly on the surface of the base 2);

12 exhalation valve (standard complete component);

13 two openings in the base 2, with the mouthpiece 3 installed in one opening and the exhalation valve positioned in another (additional) opening. The number of the openings (one or two) would depend on the presence of the mentioned valve and its fastening on the base 2;

14 means of attachment on the base 2 and on the holding canister 1 made, for example, in the form of elastic clamps positioned on the mentioned elements.

DETAILED DESCRIPTION OF THE INVENTION

The hood shall be used as follows:

The initial position of the hood is inside the package with the folded element 5 and the cover 7, i.e. in a position characterized by a compressed state of the spring 4 (not shown), with each hood typically containing an exhalation valve 12. In this position the product is of a small size (like a flat package), i.e. occupies a minimal volume and may be easily kept among the user's belongings. In the case of an emergency with a danger of a higher than normal concentration of toxic substances in the ambient air (like in fires and fumes) the user takes the hood out of the package and unfolds the bag 8. The spring that is originally compressed 4 begins automatically expanding, thus unfolding the material of the sorptive filtering element 5 and the cover 7 of heat-resistant material. First, the user blocks both nostrils by placing a noseclip on his nose, which makes him breathe through the mouth only and pull the air through the sorptive filtering element 5 and the canister 1 filled with activated coal. Then, the user puts the hood on the head, holding the bag of airtight heat-resistant transparent film 8 so as to easily introduce the mouthpiece into the mouth. Once this is done, the user begins breathing cleaned and cooled air that has passed through the cover 7, the sorptive filtering element 5 and the canister 1 holding the sorbent 15. The respiration chamber 10 formed inside the base 2 makes respiration easier and enhances air purification. Exhalation occurs through the exhalation valve 12. A simple modification of the hood makes the latter a product of multiple use. To this effect the canister 1 with the sorbent 15 is made replaceable: the canister and the base 2 bear the means of attachment in the form of elastic clamps 14.

After a one-time use the replaceable canister may be replaced with a new one. The user may have a spare canister nearby or can purchase one from a commercial outlet. Finally, the spring is pressed and the hood is folded and packed inside the package.

In this way, the proposed technical solution provides an efficient protection against hot toxic gases, aerosols and dust as a compact package, thus allowing it to be continuously carried by the user.

What is claimed is:

1. A protective hood comprising:

a bag made of air-tight, heat-resistant film, wherein said film is at least partly transparent;

a non-rigid sorptive filtering element disposed outside of said film and having at least an anti-aerosol layer and a base, wherein said base is hermetically connected to said film and contains at least one opening;

a canister filled with a solid sorbent, the canister being coupled to the non-rigid sorptive filtering element and operatively disposed proximate the base; and an operational mode shaping component comprising a compressible and expandable resilient element, the operational mode shaping component being provided within the non-rigid sorptive filtering element and in contact therewith, wherein the operational mode shaping component, when transitioning from a compressed state to an uncompressed state, unfolds a material of the non-rigid sorptive filtering element.

2. The protective hood according to claim 1, wherein the operational mode shaping component comprises a spiral spring.

3. The protective hood according to claim 2, wherein the base and the canister filled with the solid sorbent are substantially shaped in a circle, and wherein a diameter of the operational mode shaping component is smaller than or equal to diameters of said base and said canister.

4. The protective hood according to claim 3, wherein the base has a flat cylindrical shape, and a diameter of the base is larger than a height of a lateral side thereof.

5. The protective hood according to claim 1, wherein the operational mode shaping component physically contacts the canister holding the solid sorbent.

6. The protective hood according to claim 1, wherein the sorptive filtering element is multilayered.

7. The protective hood according to claim 1, wherein at least a part of the layers of the sorptive filtering element comprises a non-woven polymer fiber material, and the solid sorbent within the canister comprises activated charcoal.

8. The protective hood as according to claim 1, wherein the hood is provided with a heat-resistant cover that surrounds the sorptive filtering element.

9. The protective hood according to claim 8, wherein the heat-resistant cover is fixed on the base.

10. The protective hood according to claim 1, wherein a mouthpiece is mounted inside the opening positioned on the base.

11. The protective hood according to claim 10, wherein an exhalation valve is mounted inside an additional opening made in the base.

12. The protective hood according to claim 1, wherein the canister is detachably fixed on the base by a split connector.

13. The protective hood according to claim 12, wherein the split connector connecting the canister and the base comprises elastic clamps, wherein the clamps are positioned on a lateral side on the base.

14. The protective hood according to claim 1, wherein a dividing element is provided between the base and the canister.

15. The protective hood according claim 14, wherein the dividing element comprises at least one protrusion directed towards the canister.

* * * * *